US006926006B2

(12) United States Patent
Black

(10) Patent No.: US 6,926,006 B2
(45) Date of Patent: Aug. 9, 2005

(54) BENCH WITH SWINGING SEAT

(75) Inventor: Lester Lonnie Black, Sebring, FL (US)

(73) Assignee: Pleasure Island Products, Inc., Coral Springs, FL (US)

( * ) Notice: Subject to any disclaimer, the term of this patent is extended or adjusted under 35 U.S.C. 154(b) by 493 days.

(21) Appl. No.: 10/094,680

(22) Filed: Mar. 11, 2002

(65) Prior Publication Data

US 2003/0111876 A1 Jun. 19, 2003

Related U.S. Application Data

(60) Provisional application No. 60/341,124, filed on Dec. 13, 2001.

(51) Int. Cl.[7] ..... A61G 15/00
(52) U.S. Cl. ..... 128/845; 600/38
(58) Field of Search ..... 128/845; 600/38; 5/657; 297/273

(56) References Cited

U.S. PATENT DOCUMENTS

| | | | | | |
|---|---|---|---|---|---|
| 5,875,779 | A | * | 3/1999 | Fuhrman et al. | 128/845 |
| 6,030,039 | A | * | 2/2000 | Essler | 297/273 |
| 6,640,808 | B1 | * | 11/2003 | Fessler | 600/38 |
| 6,691,709 | B2 | * | 2/2004 | Cynn | 600/38 |
| 2004/0065331 | A1 | * | 4/2004 | Fessler | 128/845 |

* cited by examiner

*Primary Examiner*—Michael A. Brown
(74) *Attorney, Agent, or Firm*—John L. James

(57) ABSTRACT

A bench with a swinging seat has straps for securing the wrists and padded supports for the legs. The seat swings back and forth under control of the arms, legs or other moving part of the body of the user. A bracket fastened to the rear end of the bench supports a device for vaginal or anal manipulation as the seat swings back and forth.

11 Claims, 3 Drawing Sheets

BENCH WITH SWINGING SEAT

CROSS-REFERENCE TO DISCLOSURE DOCUMENT

This application of the inventor is based on his Provisional Patent Application Ser. No. 60/341,124, filed Dec. 13, 2001, entitled Bench With Swinging Seat.

FIELD OF THE INVENTION

The present invention generally pertains to a bench, and, more particularly, to an exercise bench with a movable seat.

BACKGROUND OF THE INVENTION

The human body is a complex machine that requires constant maintenance to operate at peak efficiency. Exercise is one form of maintenance that helps keep the human body functioning efficiently. There are a number of activities that exercise or otherwise stimulate various parts of the body. When the exercise or stimulation is a fun activity, a person is more inclined to participate in the activity. Sometimes, machinery or other devices are used to help exercise or stimulate various parts of the human body. Some of the newer exercise machinery provides an inclined bench on which the user lies or sits while pulling on ropes with the arms to tone the back and arms. It is desirable to have bench to that assists in making exercising more enjoyable.

A growing number of devices are now used for sexual stimulation, enrichment or gratification. Perhaps the simplest and easiest to use is a standard electric or battery operated hand held vibrator. While such vibrators provide stimulation, they fail to involve the whole body and thus fail to simulate intercourse. Other devices use a piston or motor to move a sexual assistance device to simulate intercourse, but these devices do not involve the user to the extent that intercourse would, or only require the user to be a passive participant. Accordingly, it will be appreciated that it would be highly desirable to have a sexual assistance or stimulation device that the user controls and that involves the whole body to simulate intercourse.

SUMMARY OF THE INVENTION

The present invention is directed to overcoming one or more of the problems set forth above. According to one aspect of the present invention; a bench with a swinging seat comprises a pair of inverted U-shaped members forming front and rear legs and side rails above and between the front and rear legs. Front and rear cross members are fastened to and extend between the front and rear legs. Front and rear seat mounting members are pivotally connected the inverted U-shaped members. A seat attached to the front and rear seat mounting members is disposed between the first and second U-shaped members so that the seat is free to move forward and rearward.

Pivoting is achieved by using a bracket interposed between each end of the seat mounting members and the adjacent inverted U-shaped member. An upper portion of each bracket is pivotally connected to the adjacent inverted U-shaped member while a lower portion of each bracket is pivotally connected to the seat-mounting member.

A holding bracket with an extension is fastened to the rear cross member so-that the extension is at a higher elevation than the seat. A sexual assistance device simulating a male penis is removably attached to a distal end of the extension of the holding bracket. As the seat is swung back and forth the device penetrates providing stimulation. When used without the device, the bench assists in exercising the arms, back and other parts of the anatomy.

These and other aspect, objects, features and advantages of the present invention will become more apparent from a study of the detailed description of the invention and by reference to the accompanying drawings.

DETAILED DESCRIPTION OF THE PREFERRED EMBODIMENTS

Figure 1:
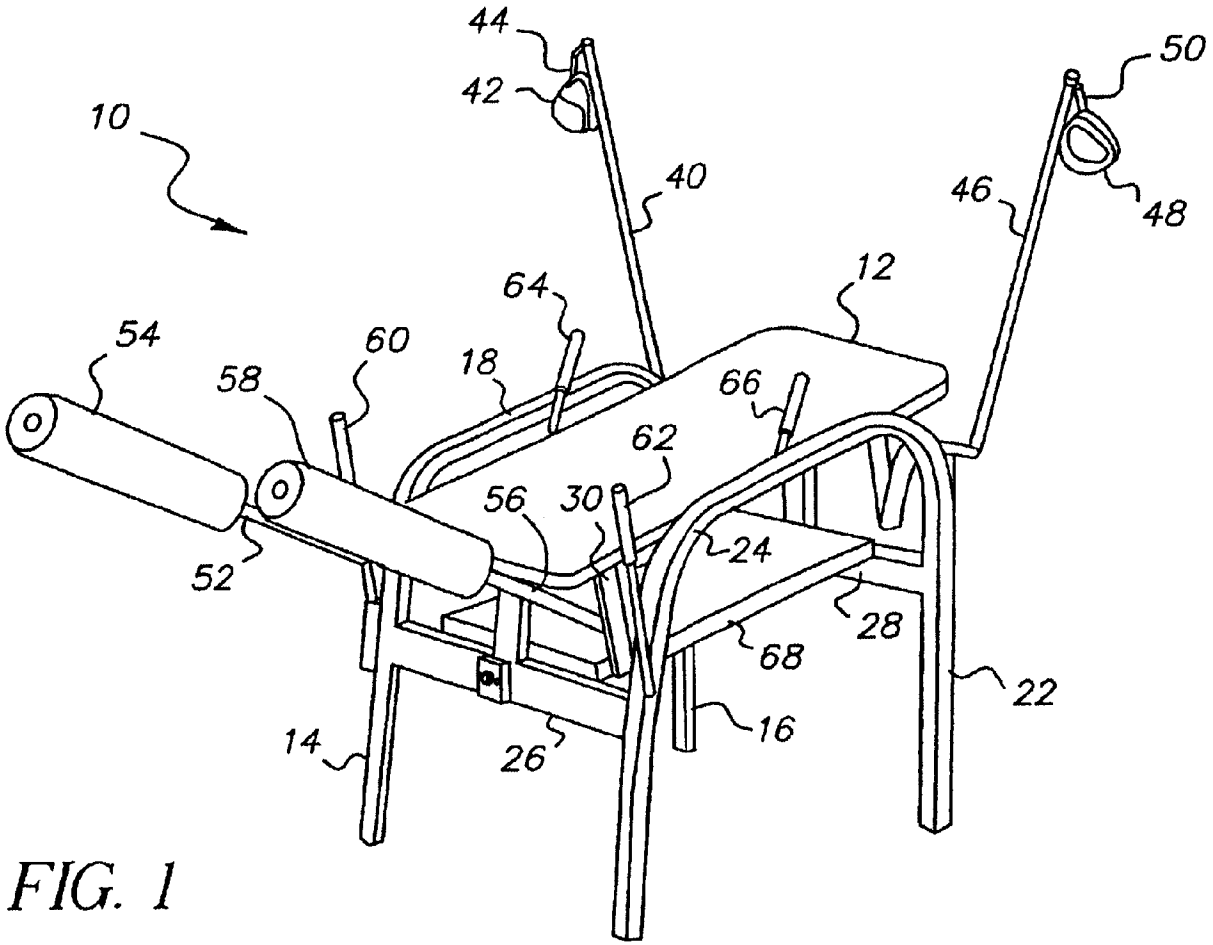
FIG. 1 is a diagrammatic perspective view of a preferred embodiment of a bench with a swinging seat according to the present invention.
Figure 2:
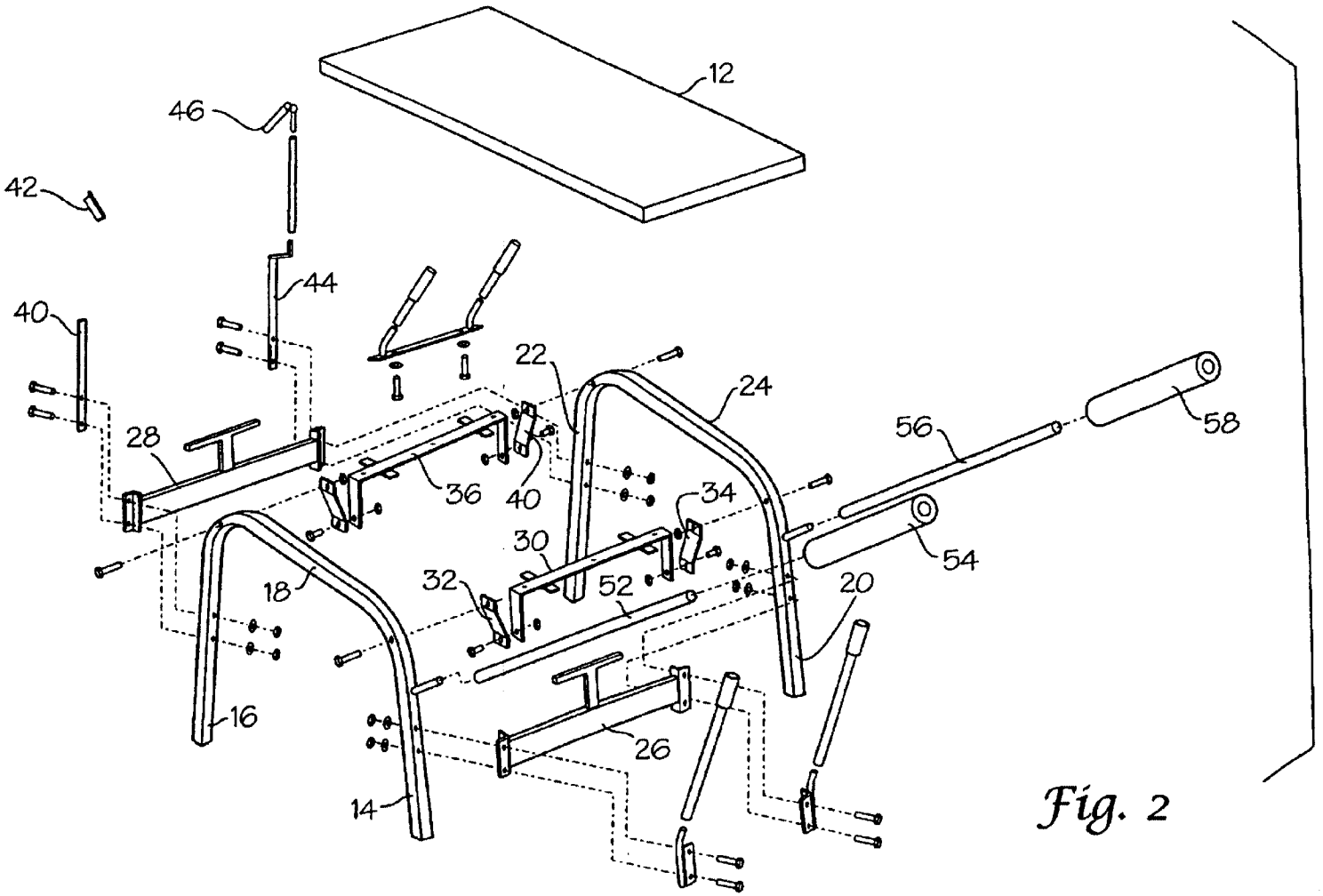
FIG. 2 is an exploded view of the bench of FIG. 1.
Figure 3:
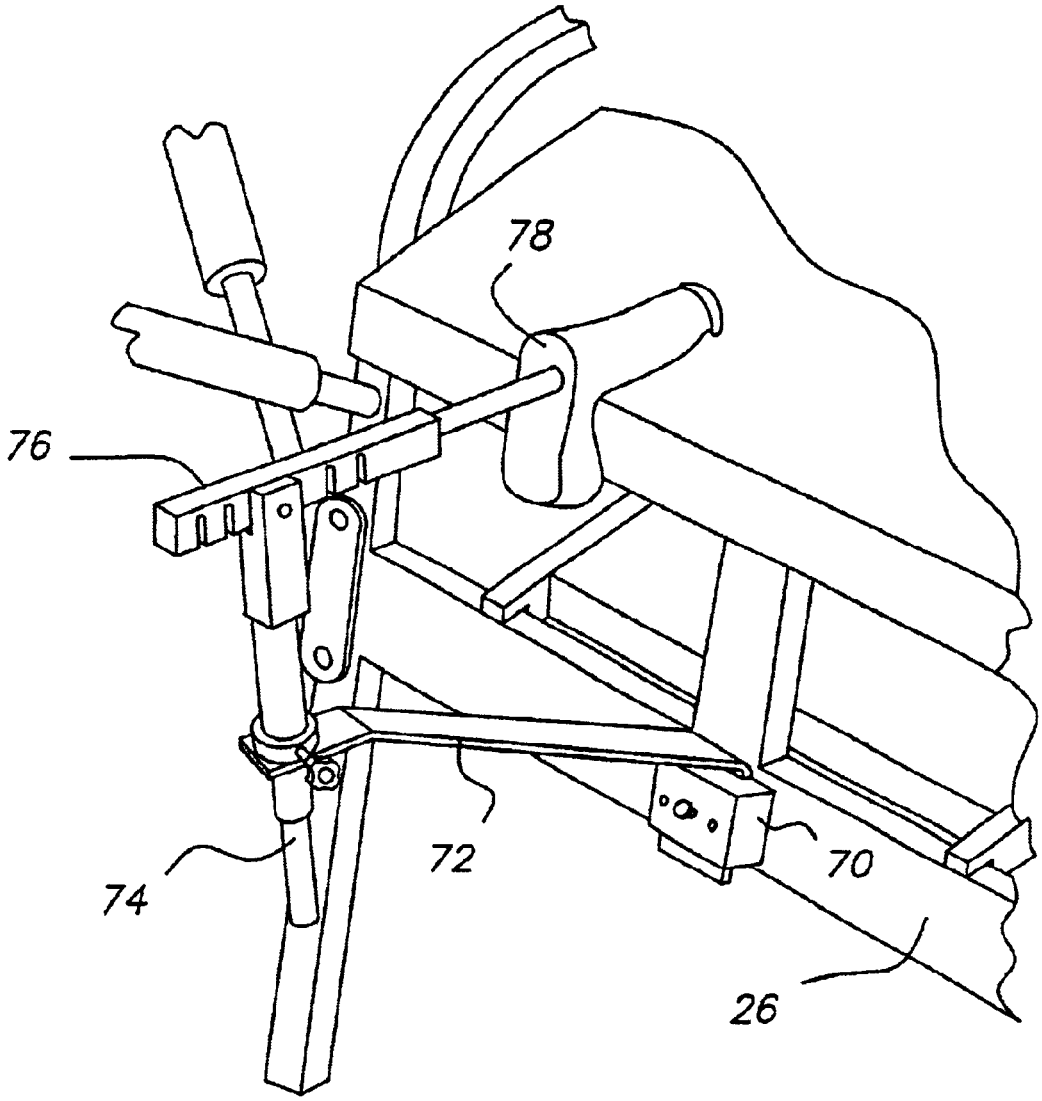
FIG. 3 is a partial view of the front end of the bench illustrating the sexual stimulation device.

Referring to FIGS. 1–3, a bench 10 has a seat 12 that swings back and forth relative to the bench framework. The framework includes a first inverted U-shaped member forming front and rear legs 14, 16 and a first side rail 18 above and between the front and rear legs 14, 16. A second inverted U-shaped member is spaced from the first inverted U-shaped member and forms front and rear legs 20, 22 and a second side rail 24 above and between the front and rear legs 20, 22. The inverted U-shaped members are preferably constructed of tubular steel or other strong durable metal. Alternatively, plastic may be used for the inverted U-shaped members. A front cross member 26 is fastened to and extends between the front legs 14, 20 while a rear cross member 28 is fastened to and extends between the rear legs 16, 22. The cross members are preferably fastened with bolts or the like for compact shipping, but may be welded for added strength and stability. The inverted U-shaped members and the cross members form the basic framework for the bench 10.

A front seat-mounting member 30 is pivotally connected to a front portion of the first and second inverted U-shaped members. The front mounting member 30 is connected to the framework by brackets 32, 34. Each bracket 32, 34 is pivotally attached to the front mounting member 30 by a bolt or the like. Each bracket 32, 34 is interposed between the front seat mounting member and an adjacent one of the first and second inverted U-shaped members. An upper portion of each bracket is pivotally connected to the adjacent one of the first and second inverted U-shaped members by a bolt or the like that extends through an opening in each member. A lower portion of each bracket is likewise pivotally connected to the front seat-mounting member.

Similarly, a rear seat-mounting member 36 is pivotally connected to a rear portion of the first and second inverted U-shaped members. The rear seat-mounting member 36 is connected to the framework by brackets 38, 40. Each bracket 38, 40 is pivotally attached to the rear mounting member 36 by a bolt or the like that extends through an opening in each member. Each bracket 38, 40 is interposed between the rear seat mounting member and an adjacent one of the first and second inverted U-shaped members. An upper portion of each bracket is pivotally connected to the adjacent one of the first and second inverted U-shaped members by a bolt or the like that extends through an opening in each member. A lower portion of each bracket is likewise pivotally connected to the rear seat-mounting member.

The seat 12 is attached to the front and rear seat mounting members 30, 36 and disposed between the first and second U-shaped members so that the seat 12 is free to move forward and rearward as the front and rear mounting members 30, 36 pivot. Seat 12 is preferably padded for comfort with a rigid interior or under surface for support.

A first vertically extending bracket 40 is fastened to rear leg 16 or to rear cross member 28. A first wrist strap 42 is attached to a distal end of vertically extending bracket 40. Strap 42 is preferably a strip of material equipped with hook and loop fasteners and attached to bracket 40 by a ring 44 that is also attached to bracket 40. The strap 42 fits about the wrist of a person disposed on said seat to secure the wrist while using the bench. The strap is preferably constructed of fabric or other breathable material.

A second vertically extending bracket 46 is fastened to rear leg 22 or to rear cross member 28. A second wrist strap 48 is attached to a distal end of vertically extending bracket 46. Strap 48 is preferably a strip of material equipped with hook and loop fasteners and attached to bracket 46 by a ring 50 that is also attached to bracket 44. The strap 48 fits about the other wrist of a person disposed on said seat to secure the other wrist while using the bench.

A first elongated, elevated, horizontal bracket 52 is fastened to front leg 14 or to front cross member 26. A pad 54 is mounted on inclined bracket 52 for comfortably supporting one leg of a person disposed on the seat 12. Pad 54 is preferably constructed of foam rubber or other open cell polyurethane foam, such as those used in upholstered furniture. The pad may have a cloth or vinyl cover. A second elongated, elevated, horizontal bracket 56 is fastened to front leg 20 or to front cross member 26. A pad 58 is mounted on inclined bracket 56 for comfortably supporting the other leg of a person disposed on the seat 12.

A first handle 60 is fastened to front leg 14 and extends vertically above the associated side rail 18. A second handle 62 is fastened to front leg 20 and extends vertically above the associated side rail 24. Handles 60, 62 are positioned for use while a person is seated on the bench to swing the seat forward and backward. Third and fourth handles 64, 66 are fastened to seat 12 and move with the seat. A person standing could use handles 64, 66 while another person lies on the seat. Handles 64, 66 are positioned for use by a person lying on the bench to swing the seat backward and forward. Thus, the seat may be swung while a person is seated or reclined, face up or face down. In addition, the arms and legs may be spread and held-spread by using the wrist straps 42, 48 and leg supports 52, 56.

Referring to FIG. 1, a tray 68 disposed below the seat between the front and rear cross members 26, 28. Tray 68 adds mass to the bench to lower the center of gravity for increased stability. Also, the tray can be used for storing articles useful with the bench. Raised side and end panel keep articles from rolling or falling off the tray. The tray may clip onto or snap onto the cross members, or may be wedged between them, or may be fastened to the cross members.

Referring to FIG. 3, a holding bracket 70 has an extension 72 and is fastened to the front cross member 26. The extension 72 has a distal end directed away from the bench. A vertical support member 74 is adjustably attached to the distal end by a clamp or set screw. A top end of support member 74 has a horizontal member 76 pivotally attached thereto. A distal end of horizontal member 76 has a distal end directed inward toward the bench. The distal end of horizontal member 76 removably receives a sexual stimulation device 78 that simulates a male pens directed inward. The sexual stimulation device 78 is at a higher elevation than the seat so that a person on the seat can insert the device vaginally or anally.

It can now be appreciated that a bench with a swinging seat has been presented. For exercising the back and arms, the user sits or lies on the seat with wrists strapped in with the wrist straps. The arm and back muscles are used to swing the seat thereby exercising them. A user can sit on the bench and use the handles for exercising the arms. With legs positioned on the leg supports, leg and thigh muscles can be exercised. When sexual stimulation or gratification is desired, a sexual stimulation device can be attached to the front end of the bench. The user can sit, kneel or lie on the seat to cause the sexual stimulation device to penetrate the vagina or anus. Increasing the arc or the swing of the seat varies the penetration. Increasing the rate of swing varies the rate of penetration and time of penetration. When penetration occurs, the user can tone vaginal or anal muscles for enhanced sexual performance. Of course, when available, another person could be used instead of the sexual stimulation device.

While the invention has been described with particular reference to the preferred embodiments, it will be understood by those skilled in the art that various changes may be made and equivalents may be substituted for elements of the preferred embodiment without departing from invention. For example, while tubular steel is preferred for the framework, other corrosion resistant metallic materials may be used, and plastic materials of suitable strength may be used as well. In addition, many modifications may be made to adapt a particular situation and material to a teaching of the invention without departing from the essential teachings of the present invention.

As is evident from the foregoing description, certain aspects of the invention are not limited to the particular details of the examples illustrated, and it is therefore contemplated that other modifications and applications will occur to those skilled in the art. For example, while the sexual stimulation appliance has been described as being horizontal, it may be adjusted to other angles to vary penetration and to accommodate a person kneeling on the bench. Also, the front legs may be shorter than the rear legs causing the bench to slant forward for increased work out of the arms and easier penetration. It is accordingly intended that the claims shall cover all such modifications and applications as do not depart from the true spirit and scope of the invention.

What is claimed is:

1. An apparatus, comprising:

a first inverted U-shaped member forming front and rear legs and a first side rail above and between said front and rear legs;

a second inverted U-shaped member forming front and rear legs and a second side rail above and between said front and rear legs;

a front cross member fastened to and extending between said front legs;

a rear cross member fastened to and extending between said rear legs;

a front seat-mounting member pivotally connected to a front portion of said first and second inverted U-shaped members;

a rear seat mounting member pivotally connected to a rear portion of said first and second inverted U-shaped members; and a seat attached to said front and rear seat mounting members and disposed between said first and second U-shaped members so that said seat is free to move forward and rearward as said front and rear mounting members pivot.

2. An apparatus, as set forth in claim 1, including a bracket interposed between one of said front and rear seat mounting members and an adjacent one of said first and second inverted U-shaped members, an upper portion of said bracket being pivotally connected to said adjacent one of said first and second inverted U-shaped members, a lower portion of said bracket being pivotally connected to said one of said front and rear seat mounting members.

3. An apparatus, as set forth in claim 1, including:

a vertically extending bracket fastened to one of said rear legs and rear cross member, and a wrist strap attached to a distal end of said vertically extending bracket, said strap being adapted to fit about the wrist of a person disposed on said seat.

4. An apparatus, as set forth in claim 1, including:

a horizontally inclined bracket fastened to one of said front legs and front cross member; and a pad mounted on said horizontally inclined bracket, said pad being adapted to support the legs of a person disposed on said seat.

5. An apparatus, as set forth in claim 1, including a handle fastened to one of said front legs and extending vertically above an associated side rail.

6. An apparatus, as set forth in claim 1, including a handle fastened to said seat and extending vertically above said seat.

7. An apparatus, as set forth in claim 1, including a tray disposed below said seat between said front and rear cross members.

8. An apparatus, as set forth in claim 7, wherein said tray adds mass to said apparatus to lower the center of gravity of said apparatus.

9. An apparatus, as set forth in claim 7, wherein said tray is a storage tray.

10. An apparatus, as set forth in claim 1, including a holding bracket having an extension and being fastened to said front cross member, said extension being at a higher elevation than said seat.

11. An apparatus, as set forth in claim 10, including a sexual device removably attached to a distal end of said extension of said holding bracket.

* * * * *